US008327586B2

(12) United States Patent
Keller et al.

(10) Patent No.: US 8,327,586 B2
(45) Date of Patent: Dec. 11, 2012

(54) HYDRAULIC CYLINDER CONTROL

(75) Inventors: Richard D Keller, Hastings, MN (US); Damian Keller, River Falls, WI (US); Daniel Keller, River Falls, WI (US); William Bakalich, Prescott, WI (US); Steven H. Schultz, Dundas, MN (US); Fred W. Sauer, St. Paul, MN (US); Jaron R. McDaniel, St. Paul, MN (US)

(73) Assignee: Hi-Fold Door Corporation, River Falls, WI (US)

( * ) Notice: Subject to any disclaimer, the term of this patent is extended or adjusted under 35 U.S.C. 154(b) by 211 days.

(21) Appl. No.: 12/698,539

(22) Filed: Feb. 2, 2010

(65) Prior Publication Data

US 2011/0185635 A1 Aug. 4, 2011

(51) Int. Cl.
*E05F 11/00* (2006.01)

(52) U.S. Cl. ..... 49/506; 49/199

(58) Field of Classification Search ..... 49/197, 49/199, 506, 138, 339, 340, 344, 345
See application file for complete search history.

(56) References Cited

U.S. PATENT DOCUMENTS 3,464,161 A 9/1969 Jonsson
3,468,060 A 9/1969 Mursinna
3,946,619 A * 3/1976 Needles et al. ..... 37/423
4,356,668 A 11/1982 Wagner
4,682,908 A * 7/1987 Domenighetti ..... 404/84.1
5,704,200 A * 1/1998 Chmielewski et al. .... 56/10.2 E
6,041,845 A * 3/2000 Couch ..... 160/201
6,246,196 B1 * 6/2001 Fitzgibbon et al. ..... 318/430
6,417,637 B2 * 7/2002 Fitzgibbon et al. ..... 318/459
6,456,022 B1 * 9/2002 Fitzgibbon et al. ..... 318/162
6,683,431 B2 * 1/2004 Fitzgibbon et al. ..... 318/468
6,710,560 B2 * 3/2004 Fitzgibbon et al. ..... 318/264
6,720,747 B1 * 4/2004 Fitzgibbon et al. ..... 318/266
6,744,231 B2 * 6/2004 Fitzgibbon et al. ..... 318/286
6,883,273 B2 4/2005 Kerkvliet
6,897,630 B2 * 5/2005 Murray et al. ..... 318/434
7,109,677 B1 * 9/2006 Gagnon et al. ..... 318/466
7,207,142 B2 * 4/2007 Mullet ..... 49/199
7,208,897 B2 * 4/2007 Hotto et al. ..... 318/466
2008/0086947 A1 4/2008 Crown

* cited by examiner

*Primary Examiner* — Katherine W Mitchell
*Assistant Examiner* — Justin Rephann
(74) *Attorney, Agent, or Firm* — Leffert Jay & Polglaze, P.A.

(57) ABSTRACT

A system and methods for controlling operation of hydraulic cylinders includes monitoring position of the cylinders relative to one another, and correction of misalignment of the cylinders should they become misaligned. Further, monitoring can be of a swing-type door operated using the cylinders, which can operate the door at different speeds. Further, as the door creeps open from a closed position or closed from an open position, correction is also made.

11 Claims, 7 Drawing Sheets

HYDRAULIC CYLINDER CONTROL

FIELD

The present disclosure relates generally to hydraulic cylinders, and in particular to the control and operation of hydraulic cylinders.

BACKGROUND

Hydraulic cylinders are used in many industrial applications, such as in robotics, heavy machinery, garage doors, and the like. Often, a pair of hydraulic cylinders, separated by a gap or attached at two different parts of an object, are employed to move the object. In the case of an object that is constrained to move in a certain way, misalignment of the cylinders can damage the object, the cylinders, or other components related to the object or cylinders. Misalignment can occur for a number of reasons, including a loss of hydraulic pressure, different relative temperatures, or the like.

Garage doors of the swing-type are typically comprised of a door that remains in a single panel configuration even when the door is being opened and is open. Such doors are often opened and closed using hydraulic cylinders. These swing-type doors are typically of either unitary construction, or are manufactured in sections that must be assembled when the door sections are delivered to an installation site, requiring additional time and effort to assemble the door.

Doors have certain stresses that act on them as they open and close. Among the stresses include gravity and other forces related to the opening and closing of the door. For example, when a door is opened, a sudden movement of the hydraulic cylinders can place a large amount of force on the door at the location of attachment to the cylinders and at far ends of the door, that is, parts of the door furthest from external support, such as the bottom of a closed door in a substantially vertical position. These stresses can lead to sudden failure of the door, or, more likely, increased wear and fatigue to the materials of the door, that can eventually lead to failure, warping, and the like, which contribute to problems with the door such as poor fit and closure, and misalignment when closed or open.

Further, hydraulic cylinders do not always operate at the exact same pace. That is, two seemingly identical cylinders of identical size, can have different operation in that one cylinder may extend faster or slower than the second cylinder, or the like. When cylinders operate at different rates, the single-piece or rigid door can be subjected to even more stress, such as twisting stress and the like. If the cylinders get too far out of alignment with respect to each other, the door could even bind in the opening, or be damaged, such as by cracking or breaking. This can be expensive and potentially dangerous depending upon the degree of damage, the size and weight of the door, and the like.

For the reasons stated above, and for other reasons stated below which will become apparent to those skilled in the art upon reading and understanding the present specification, there is a need in the art for improvements in swing type door bracing, trussing, and load distribution.

SUMMARY

In one embodiment, a method for operating a single piece garage door includes operating motion of the door in a first slow zone, an acceleration zone, a full-speed zone, a deceleration zone, and a second slow zone, respectively, for movement of the door from a first position to a second position.

In another embodiment, method of monitoring operation of a pair of hydraulic cylinders includes monitoring the pair of hydraulic cylinders for alignment therebetween, and adjusting one of the pair of cylinders when it is out of linear alignment with the other of the pair of cylinders.

In yet another embodiment, a single-piece garage door includes a main door comprising a rigid door, a door frame mounting the door in a rotatable fashion, a pair of hydraulic cylinders, a cylinder at each vertical edge of the main door and connected between the main door and the door frame, and a hydraulic control electrically connected to the hydraulic cylinders. The hydraulic control is adapted to operate motion of the door in a first slow zone, an acceleration zone, a full-speed zone, a deceleration zone, and a second slow zone, respectively, for movement of the door from a first position to a second position.

Other embodiments are described and claimed.

BRIEF DESCRIPTION OF DRAWINGS

FIGS. 6 and 7 are diagrams of a closing operation of a door according to an embodiment of the present disclosure.

DETAILED DESCRIPTION

Figure 1:
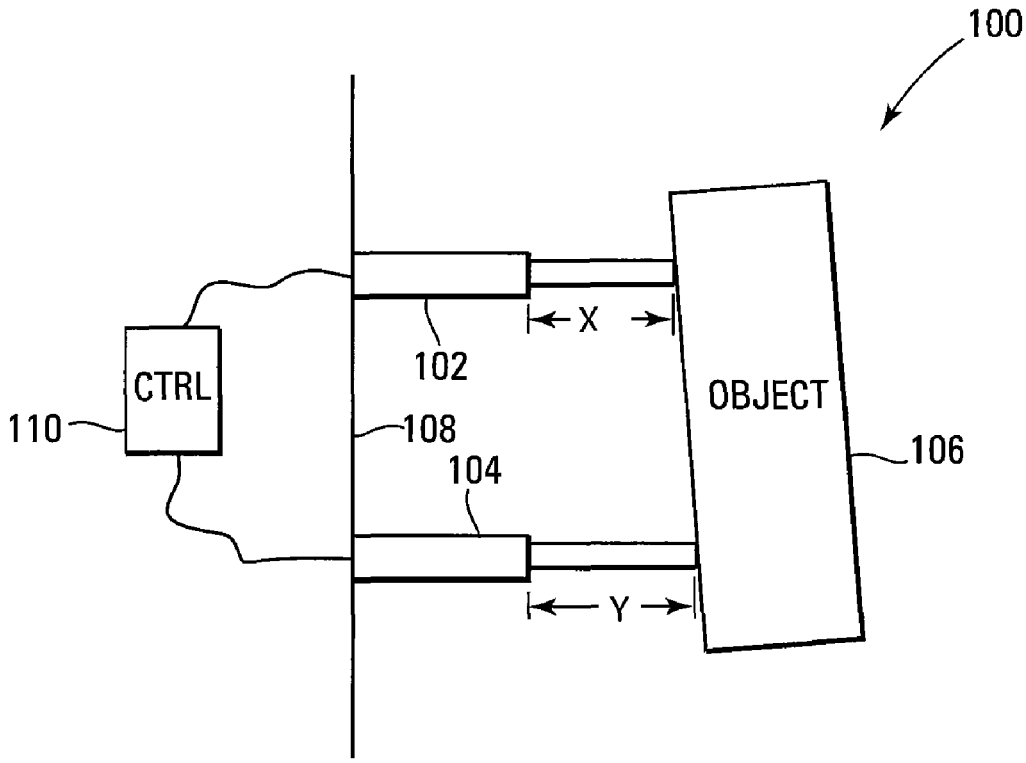
FIG. 1 is a block diagram view of a system according to one embodiment of the present disclosure.

In the following detailed description of the embodiments, reference is made to the accompanying drawings that form a part hereof. In the drawings, like numerals describe substantially similar components throughout the several views. These embodiments are described in sufficient detail to enable those skilled in the art to practice the invention. Other embodiments may be utilized and structural, logical, and electrical changes may be made without departing from the scope of the present invention.

The following detailed description is, therefore, not to be taken in a limiting sense, and the scope of the present disclosure is defined only by the appended claims, along with the full scope of equivalents to which such claims are entitled.

Embodiments of the present invention provide control for hydraulic cylinders used in groups of two or more, for which misalignment of the cylinders can lead to potential damage or other malfunction of the cylinders or the object or objects on which the cylinders are used or employed. FIG. 1 shows a system 100 having a pair of hydraulic cylinders 102 and 104 connected to control motion of an object 106. Cylinders 102 and 104 are mounted to a foundation 108 and to object 106, and are controlled by a controller 110. As shown in the Figure, cylinder 102 is extended by an amount x, and cylinder 104 is extended by an amount y. In normal operation, the extension distances x and y should be equal. In a case of misalignment, the distances x and y are different, as is shown in the Figure. Provided the foundation 108 is solid and unmoving, the difference between x and y is the amount of misalignment of the cylinders 102 and 104. Misalignment causes object 106 to be subjected to twisting forces, and can lead to misalignment or damage of the object, to damage to components of the system 100 that are proximate to the object 106, and the like.

In operation, the hydraulic cylinders operate as follows. The controller determines whether a misalignment is present, that is, whether x and y differ by a certain amount, which may be determined in a number of ways without departing from the scope of the disclosure, for example, by a percentage difference, by an absolute amount difference, or the like. The cylinder that is ahead, that is, the cylinder that is further extended (leading), in this case, cylinder 104, has its proportional control signal (which in one embodiment controls a coil with a pulse width modulation signal) reduced by a predetermined amount (in one embodiment 25%) at the first determination by the controller 110 that a predetermined linear difference (in one embodiment 0.25"), predetermined percentage difference, or the like, between cylinder 104 and cylinder 102 has occurred. If the difference continues to increase, at a second predetermined linear difference (in one embodiment 0.375"), the control signal for the leading cylinder, in this case cylinder 104, is further decreased to a predetermined percentage (in one embodiment 75%) of its full signal. Inmost typical situations, the two predetermined linear differences, or percentage differences, and reductions in control signals are sufficient to correct a typical problem the object 106 may encounter, such as but not limited to, a binding pivot point of any three areas of the object, the friction associated with movement of the object differing at different points, bending or other deformation of the object due to an obstacle or the like, et cetera.

The operation in this manner has the lagging cylinder 102 continue in its movement to attempt to fully or nearly fully eliminate the linear difference between the cylinders. If this does not occur, for example, if an increased distance variance occurs, then a determination is made in one embodiment that if the lagging cylinder 102 has not caught up, that is, eliminated or nearly eliminated the linear difference between cylinders, within a predetermined linear distance or period of time, that there is an obstruction or other condition that will not allow for correction with cylinder control of this type. At this determination, the leading, cylinder 104 is in one embodiment reversed by a determined amount (adjustable depending upon what the cylinders are used for). The point of reversal is determined in one embodiment to be at a percentage or linear difference point between cylinders greater than the second predetermined linear difference (in one embodiment 0.5"). At this point, the control signal is completely shut down for the cylinders, and coils to operate the cylinders in an opposite direction are energized to reverse the cylinders by a predetermined amount, in one embodiment two (2) inches.

Specific embodiments of the present invention provide control for the hydraulic cylinders of a rigid (or swing-type) door that maintain cylinder alignment. Further embodiments provide operation of the door opening and closing at differing speeds depending upon the portion of the opening or closing operation that is occurring at the time. Still further embodiments provide operation to maintain the door in a closed position without it creeping to a partially open position.

Figure 2:
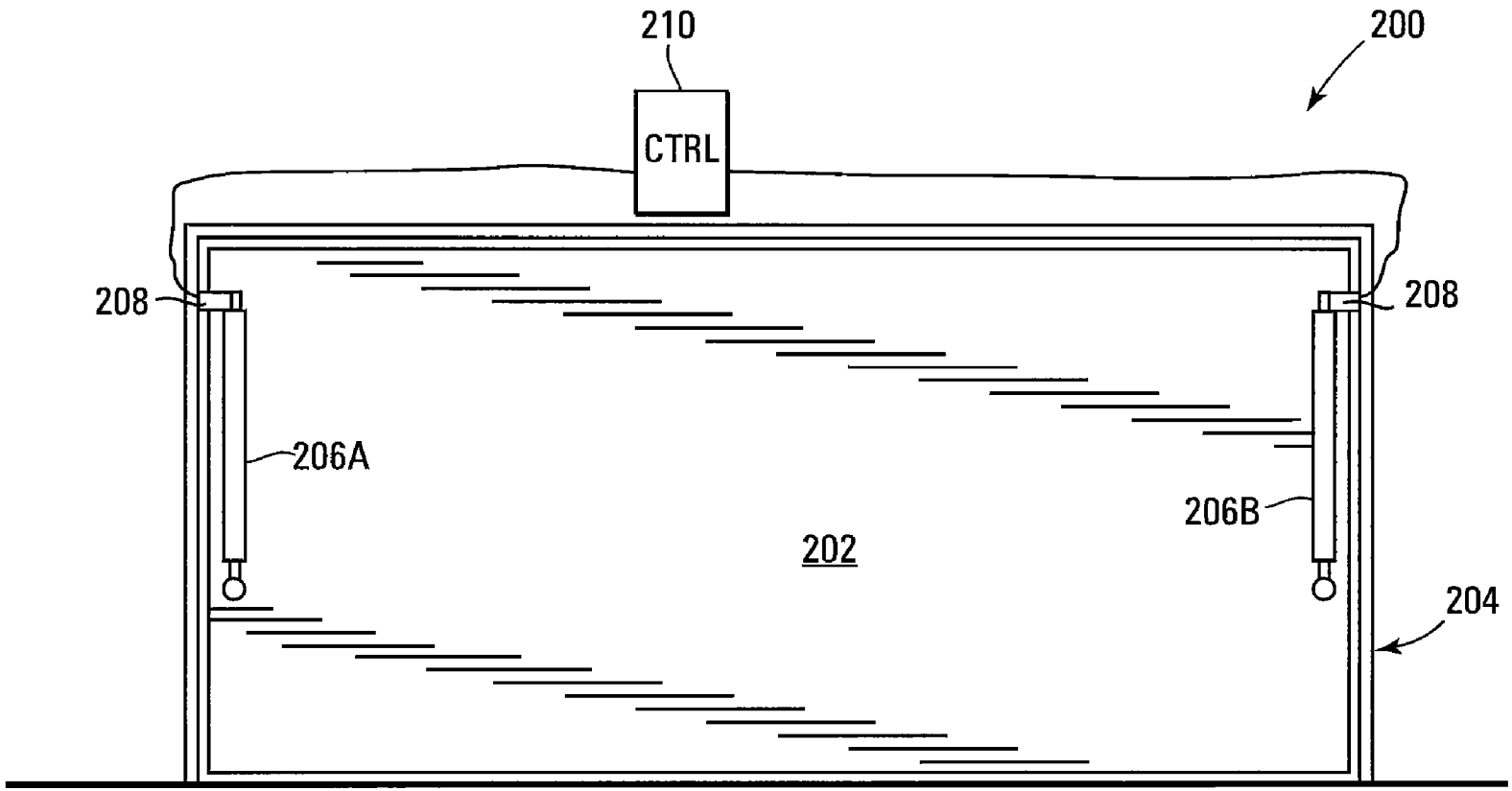
FIG. 2 is an elevation view of a door in a closed position according to an embodiment of the present disclosure.
Figure 2A:
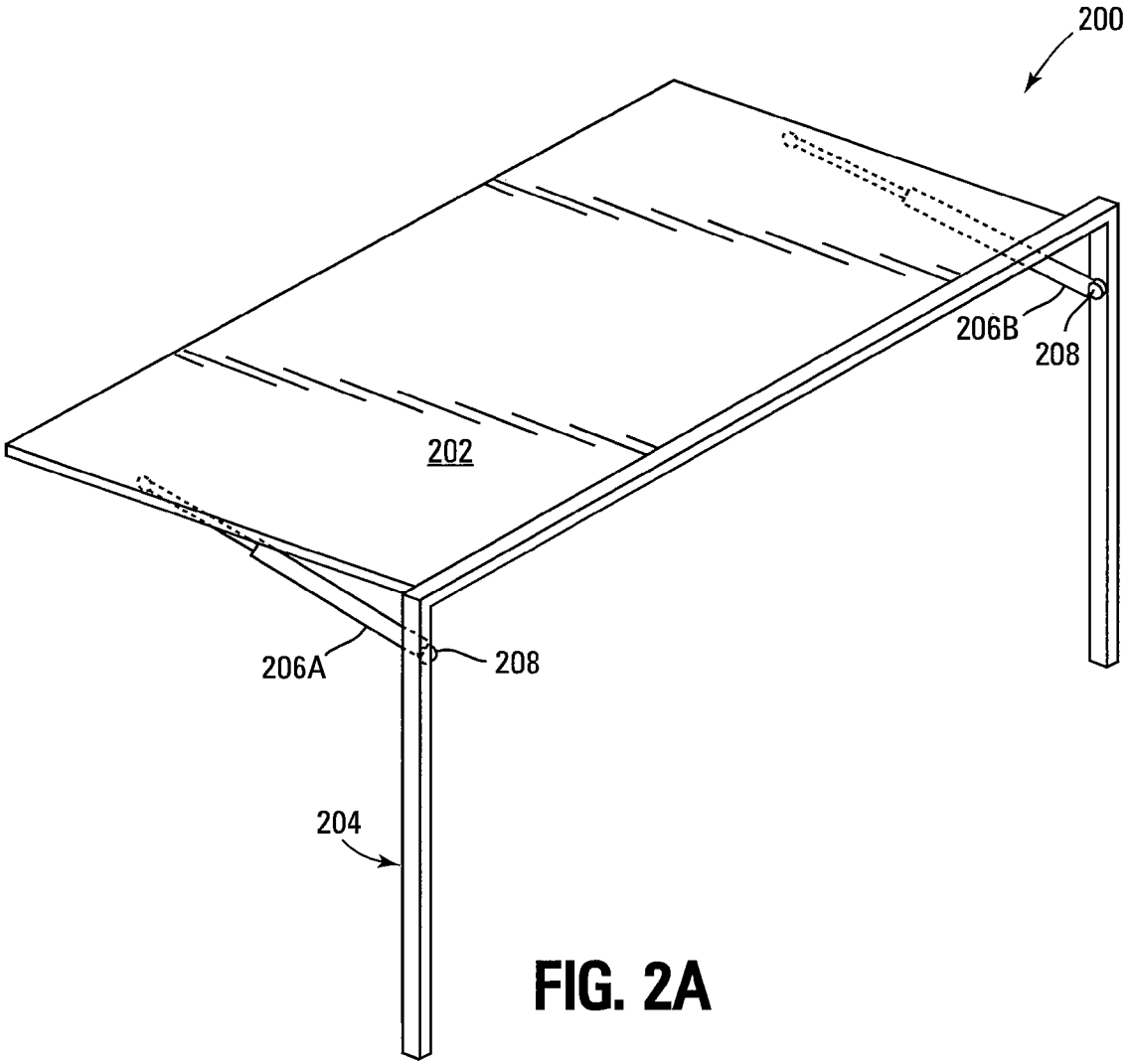
FIG. 2A is a perspective view of a door in an open position according to an embodiment of the present disclosure.

A single-piece rigid garage door structure 200 as shown in a closed position in FIG. 2 and in an open position in FIG. 2A includes a main door 202 comprising a rigid door, typically in one piece, or assembled in rigid form from a plurality of smaller pieces, but having the feature of operating as a single rigid piece, a door frame 204 mounting the door 202 in a rotatable fashion to the frame or other external structure such as a building or the like, and a pair of hydraulic cylinders 206A and 206B, a cylinder at each vertical edge 208 of the main door 202 and connected between the main door 202 and the door frame 204 or building. The cylinders 206A and 206B are responsible for opening and closing the door 202. The operation of the cylinders extending and retracting causes the door to open or close. A hydraulic control 210 is electrically connected to the hydraulic cylinders 206A and 206B, and controls operation of the cylinders and therefore the opening and closing of the door. It should be understood that additional cylinders may be used without departing from the scope of the disclosure.

Hydraulic cylinders used to open and close a door such as a one-piece rigid garage door or the like can get out of synchronization, that is, be further linearly open or closed than the other cylinder. When this occurs, the door can be subject to excess forces. Such cylinder misalignment can be caused by a number of factors, for example and not by way of limitation, by a misaligned or skewed, i.e., warped, door; by external forces on the door, including but not limited to weather conditions, obstacles and obstructions. When the cylinders get out of alignment, the door may even jam. In one embodiment, the linear position of each cylinder with respect to a known, or home, position, is monitored. If the cylinders differ in linear position by more than a certain amount, which can be set depending on the usage of the door or any other factor, corrective action is taken. Corrective action is, in one embodiment, stopping one of the cylinders until the cylinders are within the alignment distance or tolerance.

Figure 3:
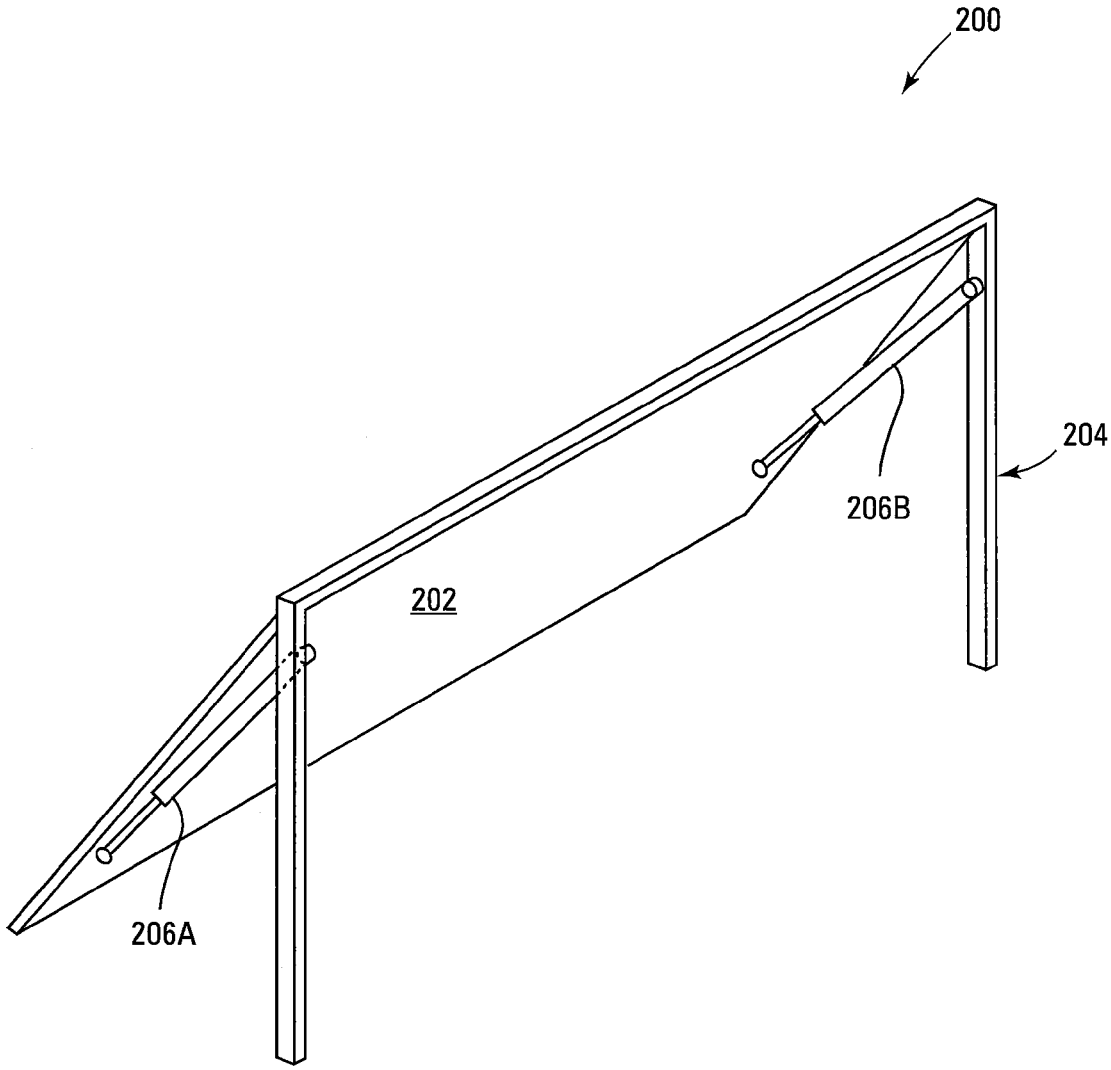
FIG. 3 is a perspective view of a door in a partially opened position according to an embodiment of the present disclosure.

The decision on which cylinder to stop is made depending upon the direction of travel of the door, and can be changed without departing from the scope of the disclosure. For example, referring to FIG. 3, where the door 202 is shown being opened, if cylinder 206A is extended further linearly than cylinder 206B by more than a predetermined amount, cylinder 206A can be stopped from further extension until cylinder 206B is extended by an amount within the tolerance set for difference in the extension. Once the cylinders 206A and 206B are extended by the same amount, or within the predetermined tolerance from the same amount, operation of the door continues. Alternatively, if cylinder 206A is extended further than cylinder 206B by more than the predetermined amount, the extension speed of cylinder 206B can be increased until the cylinders are within the tolerance amount of the same extension.

If the cylinders continue to become more misaligned for any reason, this is also monitored, and if the alignment difference exceeds a second tolerance larger than the first tolerance, the both cylinders can be stopped, or reversed, or one cylinder can be reversed, until the difference in cylinder extension is within the first tolerance.

In operation, the hydraulic cylinders operate as follows. In an OPEN mode or a CLOSE mode, that is, to open or to close the door, the correction parameters for controlling the cylinders are the same. The cylinder that is ahead (leading), in this case, cylinder 206A, has its proportional control signal (which in one embodiment controls a coil with a pulse width modulation signal) reduced by a predetermined amount (in one embodiment 25%) at the first determination by the controller 210 that a predetermined linear difference (in one embodiment 0.25") between cylinder 206A and cylinder 206B has occurred. If the, difference continues to increase, at a second predetermined linear difference (in one embodiment 0.375"), the control signal for the leading cylinder, in this case cylinder 206A, is further decreased to a predetermined percentage (in one embodiment 75%) of its full signal. In most typical situations, the two predetermined linear differences and reductions in control signals are sufficient to correct a typical problem the door 202 may encounter, such as but not limited to, strong wind on one end of the door, a binding pivot point of any three areas of the door, snow, weight of the door being unequal from one side to the other, frost lift concrete under one side of door creating slow speed zone restriction, shifted building from settling, door frame misalignment, and the like.

The operation in this manner has the lagging cylinder 206B continue in its movement to attempt to fully or nearly fully eliminate the linear difference between the cylinders. If this does not occur, for example, if an increased distance variance occurs, then a determination is made in one embodiment that if the lagging cylinder 206B has not caught up, that is, eliminated or nearly eliminated the linear difference between cylinders, within a predetermined linear distance or period of time, that there is an obstruction or other condition that will not allow for correction with cylinder control of this type. At this determination, the leading cylinder 206A is in one embodiment reversed by a determined amount (in one embodiment two (2) inches). The point of reversal is determined in one embodiment to be at a linear difference point between cylinders greater than the second predetermined linear difference (in one embodiment 0.5"). At this point, the control signal is completely shut down for the cylinders, and coils to operate the cylinders in an opposite direction are energized to reverse the cylinders, and therefore the door itself, by a predetermined amount, in one embodiment two (2) inches. This operation is in one embodiment at the slow speed zone speed of operation, described further below.

Figure 4:
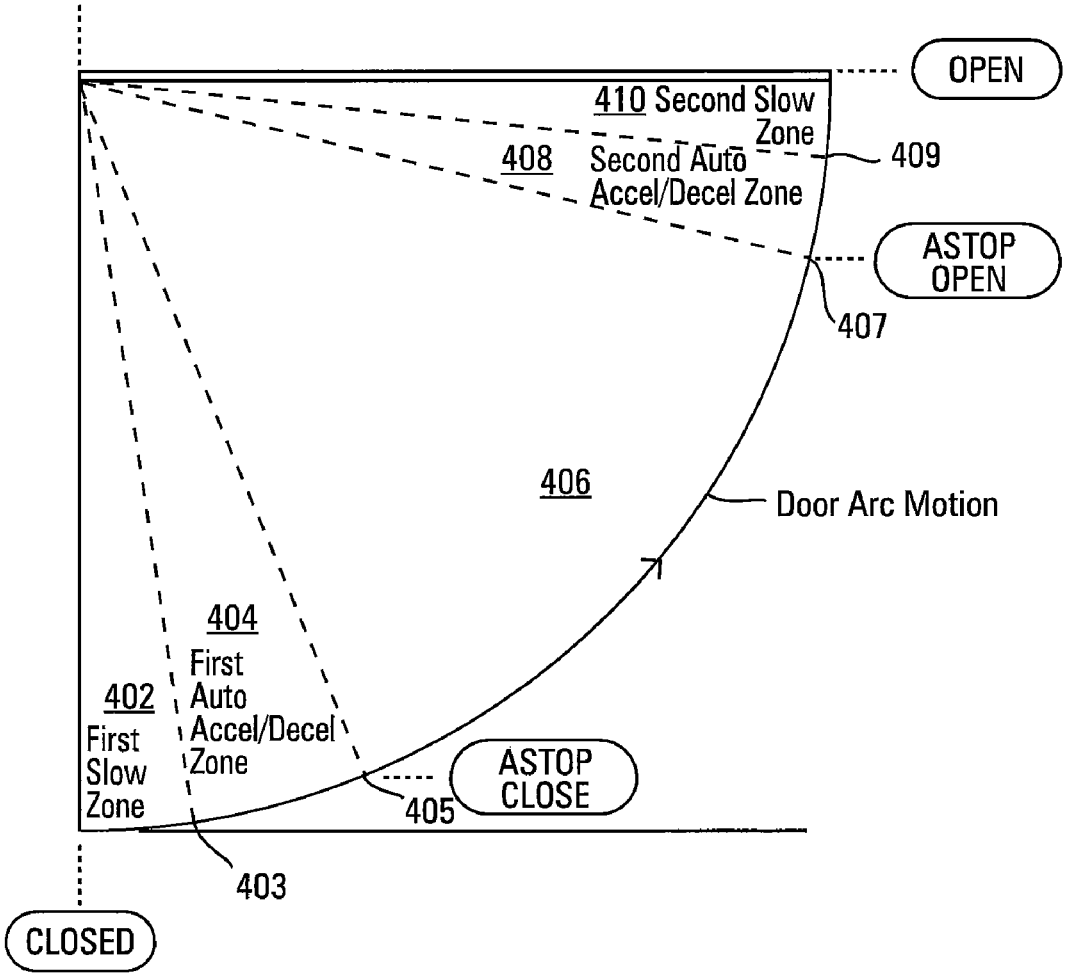
FIG. 4 is a diagram of a closing operation of a door according to an embodiment of the present disclosure.

An open operation functions as is shown and described with reference to FIGS. 4 and 5. Upon initiation of a door open procedure, such as from a remote control or a dedicated hard-wired opener, the door 202 begins to open at a first speed. This first speed is referred to as a first slow speed, and is the speed of the door in a first slow zone 402, at a known speed setting referred to as the first slow speed. The door moves through the first slow zone 402 until it has traveled through an arc encompassing the first slow zone, and reaches a point 403 at the start of a first acceleration/deceleration zone 404, which is an acceleration zone in an open function. At this point 403, the speed of the door is increased in a ramping acceleration within zone 404 to a second speed, which in one embodiment is the full speed of the door, which is reached at point 405. In the acceleration zone 404, the speed of the door ramps from the first speed to the second speed. Operation of the door is at the second speed in the full-speed zone 406.

During opening of the door, at a further point 407 of travel in the arc of travel of the door, the door is nearly to its fully open position. The door reaches point 407 at the start of second acceleration/deceleration zone 408, which is a deceleration zone in an open function. At this point 407, the speed of the door is decreased in a ramping deceleration within zone 408 from the second speed to a third speed also referred to as a second slow speed. The second slow speed is reached at point 409, and operation of the door continues at the third speed in the second slow zone 410 until the door is fully open.

Figure 5:
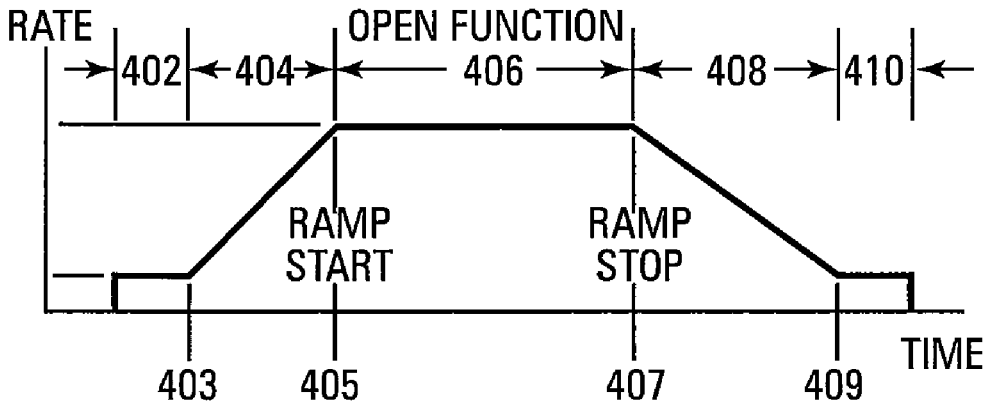
FIGS. 5 and 6 are diagrams of an opening operation of a door according to an embodiment of the present disclosure.

In one embodiment, the angular arc of motion of the acceleration zone 404 is greater than the angular arc of motion for the deceleration zone 408 as is shown in FIG. 5. however, it should be understood that the arcs subtended by the various zones may be adjusted depending upon door parameters, and need not be those shown in the Figures.

Figure 6:
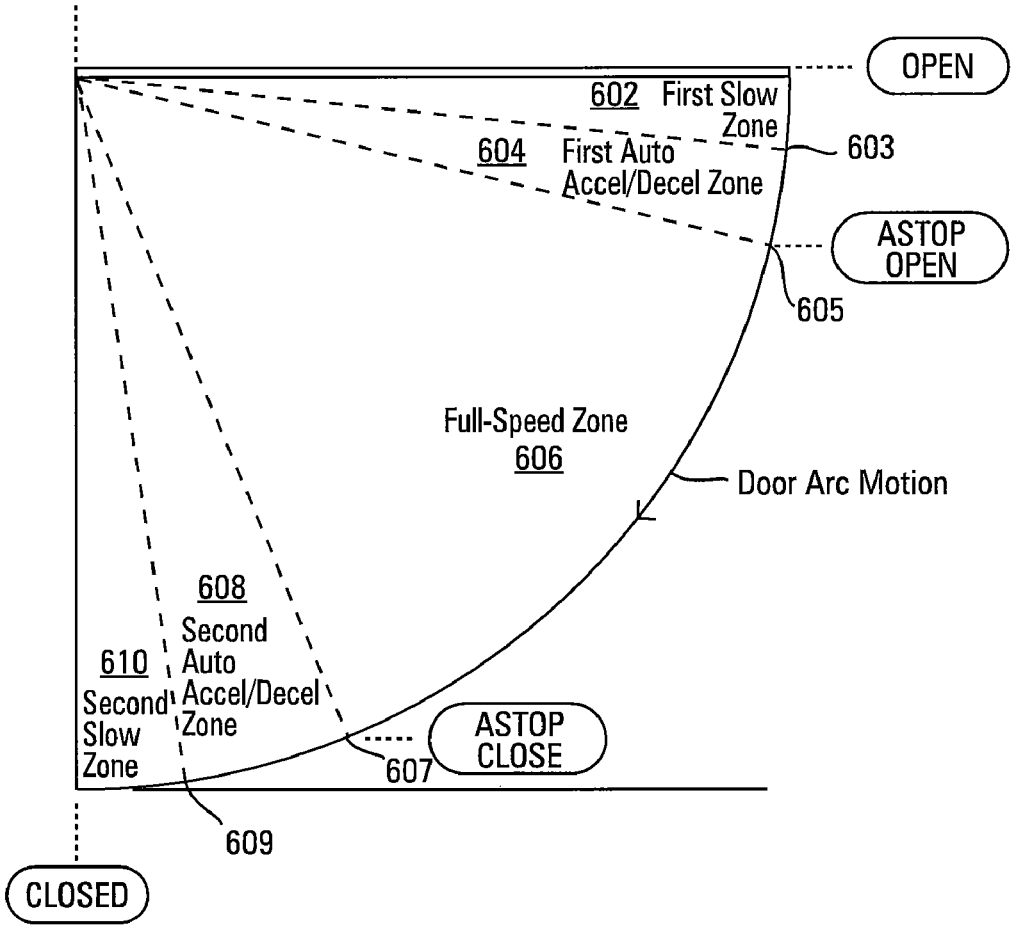

A close operation functions as is shown and described with reference to FIGS. 6 and 7. Upon initiation of a door close, procedure, such as from a remote control or a dedicated hard-wired opener, the door 202 begins to close at a first speed. This first speed is referred to as a first slow speed, and is the speed of the door in a first slow zone 602, at a known speed setting referred to as the first slow speed. The door moves through the first slow zone 602 until it has traveled through an arc encompassing the first slow zone, and reaches a point 603 at the start of a first acceleration/deceleration zone 604, which is an acceleration zone in a close function. At this point 603, the speed of the door is increased in a ramping acceleration within zone 604 to a second speed, which in one embodiment is the full speed of the door, which is reached at point 605. In the acceleration zone 604, the speed of the door ramps from the first speed to the second speed. Operation of the door is at the second speed in the full-speed zone 606.

During closing of the door, at a further point 607 of travel in the arc of travel of the door, the door is nearly to its fully closed position. The door reaches point 607 at the start of second acceleration/deceleration zone 608, which is a deceleration zone in a close function. At this point 607, the speed of the door is decreased in a ramping deceleration within zone 608 from the second speed to a third speed also referred to as a second slow speed. The second slow speed is reached at point 609, and operation of the door continues at the third speed in the second slow zone 610 until the door is fully closed.

Figure 7:
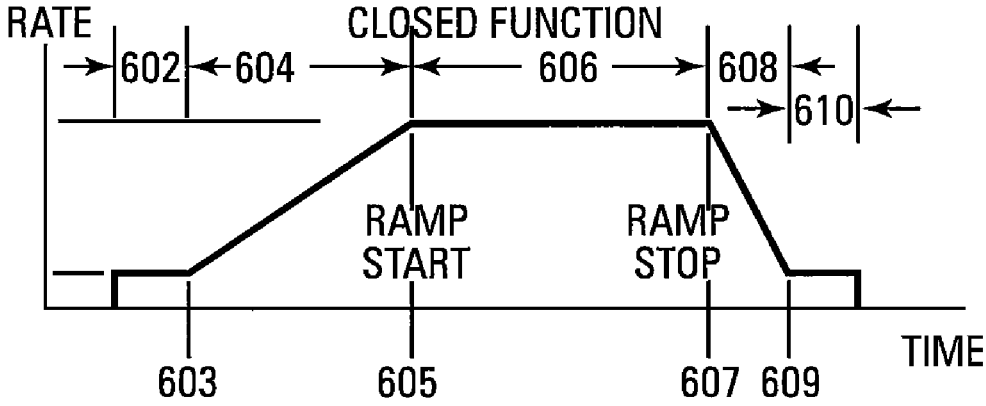

In one embodiment, the angular arc of motion of the acceleration zone 604 is greater than the angular arc of motion for the deceleration zone 608 as is shown in FIG. 7. however, it should be understood that the arcs subtended by the various zones may be adjusted depending upon door parameters, and need not be those shown in the Figures.

It should further be understood that similar zones may be used for moving the door more open or more closed from any position, including partially or fully open, or partially or fully closed, to any other position, or for moving the door from one partially open position to another partially open position, either more open or more closed than the first position, without departing from the scope of the disclosure. Operation of the door to a more open position uses the open function described in FIGS. 4 and 5, and operation of the door to a more closed position uses the, close function described in FIGS. 6 and 7.

Different doors may have different heights, sizes, and operational modes, and therefore, the points in the arc of travel for the transition between the slow speed zone and the acceleration and deceleration zones are adjustable by a user.

The ramps for acceleration and deceleration are not necessarily the same, but can be The amount of arc used for acceleration and deceleration is not necessarily the same, but it can be. The slow speed for the beginning of an opening process and the slow speed for the end of the opening process are not necessarily the same, but they can be. The slow speed for the beginning of a closing process and the slow speed for the end of the closing process are not necessarily the same, but they can be.

In either an open position or a closed position, the door can creep closed or creep open some amount due to any number of factors. In an open door, these factors include, but are not limited to, internal or external hydraulic fluid leakage from one or both cylinders. For example, external leakage could occur at an oil connecting point or the like, and internal leakage could be caused by a damaged check valve or the like.

In a closed door, door creep factors include but are not limited to, internal or external hydraulic fluid leakage from one or both cylinders, thermal contraction, settling of the door, or the like. When a door begins to creep, a standby mode is engaged in one embodiment. In the standby mode, the cylinder position is monitored as in the opening and closing modes. When a cylinder gets misaligned with the other cylinder by a determined amount (in one embodiment 0.25"), the controller notes the occurrence and performs one of two operations, either fully opening or closing the door, or timing out for a period of time before checking again and then fully opening or closing the door. In the first operation, fully opening of closing the door, the controller operates the cylinders as follows. If only one cylinder has changed position, that cylinder can be fully extended or retracted in slow speed zone mode until both cylinders are fully extended or retracted. Alternatively, if both cylinders have changed position, slow speed zone movement is initiated on both cylinders to fully open or close the door.

A series of cycles are followed in one embodiment for correction of door creep. If the door is still undergoing door creep after a certain number (in one embodiment three) cycles over a predetermined time, an error is indicated.

CONCLUSION

Systems and methods have been described that control operation of hydraulic cylinders for movement of an object, such as in one embodiment a swing-type garage door. The embodiments allow for monitoring of the cylinders, and for correcting misalignment of the cylinders should they become misaligned. In specific embodiments, as the door creeps open from a closed position or closed from an open position, correction is also made.

Although specific embodiments have been illustrated and described herein, it will be appreciated by those of ordinary skill in the art that any arrangement, which is calculated to achieve the same purpose, may be substituted for the specific embodiment shown. This application is intended to cover any adaptations or variations of the present invention. Therefore, it is manifestly intended that this invention be limited only by the claims and the equivalents thereof.

What is claimed is:

1. A method for operating a single piece garage door, comprising:

operating motion of the door in a first slow zone, an acceleration zone, a full-speed zone, a deceleration zone, and a second slow zone, respectively, for movement of the door from a first position to a second position:

wherein motion of the door is effected by a pair of hydraulic cylinders controlled to move the door at a first speed in the first slow zone, at a second speed in the second slow zone, and at a full speed in the full-speed zone, and to ramp the speed of the door from the first speed to the full speed in the acceleration zone, and from the full speed to the second speed in the deceleration zone;

determining a linear extension position of each hydraulic cylinder; and adjusting one of the cylinders when it is out of linear extension alignment with the other cylinder.

2. The method of claim 1, wherein motion of the door in the first slow zone is at a first speed.

3. The method of claim 1, wherein motion of the door in the acceleration zone accelerates from the first speed to a full speed at a determined rate.

4. The method of claim 1, wherein motion of the door in the full speed zone operates door motion at a full speed higher than the first speed.

5. The method of claim 1, wherein motion of the door in the deceleration zone decelerates from the full speed to a second speed at a determined rate.

6. The method of claim 1, wherein motion of the door in the second slow zone is at a second speed.

7. The method of claim 1, wherein acceleration and deceleration of door motion in the acceleration zone and the deceleration zone respectively are ramped.

8. The method of claim 1, wherein adjusting further comprises:

lowering a cylinder speed for an out of linear extension alignment cylinder or increasing a cylinder speed for an out of linear extension alignment cylinder to bring it into extension alignment with the other cylinder.

9. The method of claim 1, wherein adjusting further comprises:

stopping operation of all cylinders when an extension alignment difference reaches a determined maximum.

10. The method of claim 1, wherein adjusting further comprises:

aligning the linear extension position of all cylinders of the at least two cylinders dynamically.

11. The method of claim 1, wherein monitoring is performed using a controller to determine the linear extension position of each cylinder, compare the linear extension positions of each cylinder to the other cylinder, and adjust the cylinder linear extension position based on the relative linear position of the cylinders.

* * * * *